US006929401B2

(12) United States Patent
Matusewicz

(10) Patent No.: US 6,929,401 B2
(45) Date of Patent: Aug. 16, 2005

(54) NESTED SAFETY MAILING ENVELOPE

(75) Inventor: Richard S. Matusewicz, San Jose, CA (US)

(73) Assignee: Beckman Coulter, Inc., Fullerton, CA (US)

( * ) Notice: Subject to any disclaimer, the term of this patent is extended or adjusted under 35 U.S.C. 154(b) by 48 days.

(21) Appl. No.: 10/413,869

(22) Filed: Apr. 15, 2003

(65) Prior Publication Data

US 2004/0208401 A1 Oct. 21, 2004

(51) Int. Cl.[7] ..... B65D 30/08

(52) U.S. Cl. ..... 383/113; 383/40; 383/61.1; 383/84; 383/116; 383/98; 229/72; 229/80

(58) Field of Search ..... 383/84, 61.1, 113, 383/116, 98, 40; 229/72, 80

(56) References Cited

U.S. PATENT DOCUMENTS 892,074 A * 6/1908 Obici ..... 53/411
2,583,240 A * 1/1952 Thompson ..... 206/496
2,689,079 A * 9/1954 Timer ..... 206/521
3,596,828 A * 8/1971 Foster et al. ..... 383/94
3,743,173 A * 7/1973 Lasker ..... 206/521
3,944,132 A 3/1976 Caprile et al.
3,979,051 A 9/1976 Close
4,192,447 A 3/1980 Ambrosat et al.
4,305,506 A 12/1981 Greenwald
4,353,770 A * 10/1982 Kuckhermann ..... 156/308.4
4,421,150 A * 12/1983 Masters ..... 383/61.1
4,505,385 A * 3/1985 Focke et al. ..... 206/260
4,619,399 A 10/1986 Szmuk et al.
4,669,651 A 6/1987 Shaw et al.
5,048,692 A * 9/1991 Handler et al. ..... 383/203
5,150,971 A 9/1992 Strong et al.
5,174,659 A 12/1992 Laske
5,713,511 A 2/1998 Diamond
6,048,098 A 4/2000 Vetter

* cited by examiner

*Primary Examiner*—Jes F. Pascua
(74) *Attorney, Agent, or Firm*—Schneck & Schneck; Thomas Schneck; David M. Schneck

(57) ABSTRACT

A nested safety mailing envelope having a first and second compartment. The first compartment is attached within the second compartment. Each compartment has a seal that may securely seal each compartment. The seals are in line such that the inner compartment seal may be closed and the outer compartment seal provides a secondary enclosure of the inner compartment.

5 Claims, 1 Drawing Sheet

NESTED SAFETY MAILING ENVELOPE

TECHNICAL FIELD

The present invention relates to mailing envelopes and specifically to mailing envelopes that may be used to send diagnostic specimens.

BACKGROUND OF THE INVENTION

A number of medical diagnostic assays are designed to allow for use at the home of a patient. This reduces the cost of the assay by minimizing a medical practitioner's time required for each diagnostic assay. This is also more convenient for a patient, especially for tests that require that the patient take a sample on a number of consecutive days. Typically, the patient will apply a patient sample to a diagnostic device, such as a test card, applying samples once or once a day for several days to the test card. After the final sample is applied, the test card is sent to a medical practitioner or lab for analysis.

One example of such an assay is the fecal occult blood test sold by Beckman Coulter (Fullerton, Calif.) under the name Hemoccult® SENSA®. This assay requires a user to apply a fecal sample to a test card. This assay may either be a single application card or a series of jointed cards to which a fecal sample is applied once a day for a period of three days. Following the application of the final sample, this test card is mailed to a medical center where the applied samples are tested and the results analyzed.

Mailing such cards raises certain safety concerns. Postal and transport agency workers should not be exposed to patient samples, which may contain contagious agents. Given the present attention to safety and security, such safety concerns have become increasingly important. To address these concerns, rules have been proposed to be added to the Federal Register 39 CFR Part 111 to revise the standards for domestic mail. The proposed mailing regulations for diagnostic shipments are outlined in Section 8 of the proposed regulations. For dry specimen samples, the samples must be completely dried, and then enclosed in a primary receptacle. The primary receptacle then is enclosed in a secondary receptacle, which may serve as the outer shipping container. The secondary container must have a leak proof barrier, which would prevent both leaks from the primary container and leaks into the primary container should this mailing come into contact with a liquid.

Presently, diagnostic tests have a mailing envelope that is sent with the test. An inner layer of the envelope is waterproof to contain the material within the envelope. The outer layer of the envelope is made of a durable, tear resistant material to ensure safe transport. Generally these materials are bonded together to form a single compartment envelope for mailing.

U.S. Pat. No. 5,150,971 discloses one mailing envelope for mailing a diagnostic specimen. This envelope includes a front panel joined to a back panel, having three sides sealed together. The flap of the envelope includes at least one tab which may be folded over and secured, such that the flap and flap tab(s) are affixed to both the front and back panel.

The most common solution for compliance with the regulations is envisioned to be the use of two separate envelopes. The user would place the test card into a first envelope that would then be sealed. This envelope would then be placed into a second envelope, which is sealed. However, it is probable that a number of patients would simply discard one of the envelopes and mail the test card in one of the two envelopes. This is more likely for those tests that require a number of days to complete.

A number of different envelopes have been devised to address various mailing needs. A number of such envelopes have multiple compartments. For example, U.S. Pat. No. 4,669,651 discloses an envelope having a number of side flaps that fold over each other to form a number of staggered pockets within an envelope compartment. A single flap covers all pockets to seal these pockets. U.S. Pat. No. 3,979,051 discloses an alternative multicompartment envelope, having a top pocket and a side pocket in which overlapping construction is used to make the envelope more tear resistant. This envelope does not have sealing flaps. U.S. Pat. No. 4,669,651 discloses an envelope having a number of compartments and a single flap that seals all of the compartments. The pockets are vertically displaced by a displaced bottom portion so that the top of each compartment may be labeled and viewed, and so that all compartments may be the same depth. U.S. Pat. No. 4,305,506 discloses an envelope having an inner return envelope nested in a foldable single sheet that forms an outer envelope. None of these envelopes meet the standards for mailing a diagnostic device as set out in the Federal Regulations.

It is an object of the invention to provide an envelope for mailing diagnostic or other samples that meets the proposed federal guidelines for mailing such samples. This envelope should minimize the risk that a user would mistakenly violate the guidelines by failing to use a primary and a secondary compartment for mailing a diagnostic sample. All references noted herein are hereby incorporated by reference.

SUMMARY OF THE INVENTION

The above objects have been achieved with an envelope having multiple barriers. This envelope has a primary compartment (inner compartment) and a secondary compartment (outer compartment). The inner compartment is positioned inside the outer compartment with the openings of each of the compartments in line. Material introduced into the first compartment would also be enclosed by the second compartment. The first and second compartments are affixed together such that they may not be separated without tearing. The compartments are joined to make a unitary structure. This structure prevents a user from separating the compartments.

As required by the proposed regulations, the secondary compartment has a leak proof barrier so that leaks are contained. The first compartment may also have a leak proof barrier.

Each compartment is individually sealed, with the second compartment sealing in the first compartment. The seal may be a flap on each compartment. Closure of the flaps seals the compartments.

BEST MODE OF CARRYING OUT THE INVENTION

Figure 1:
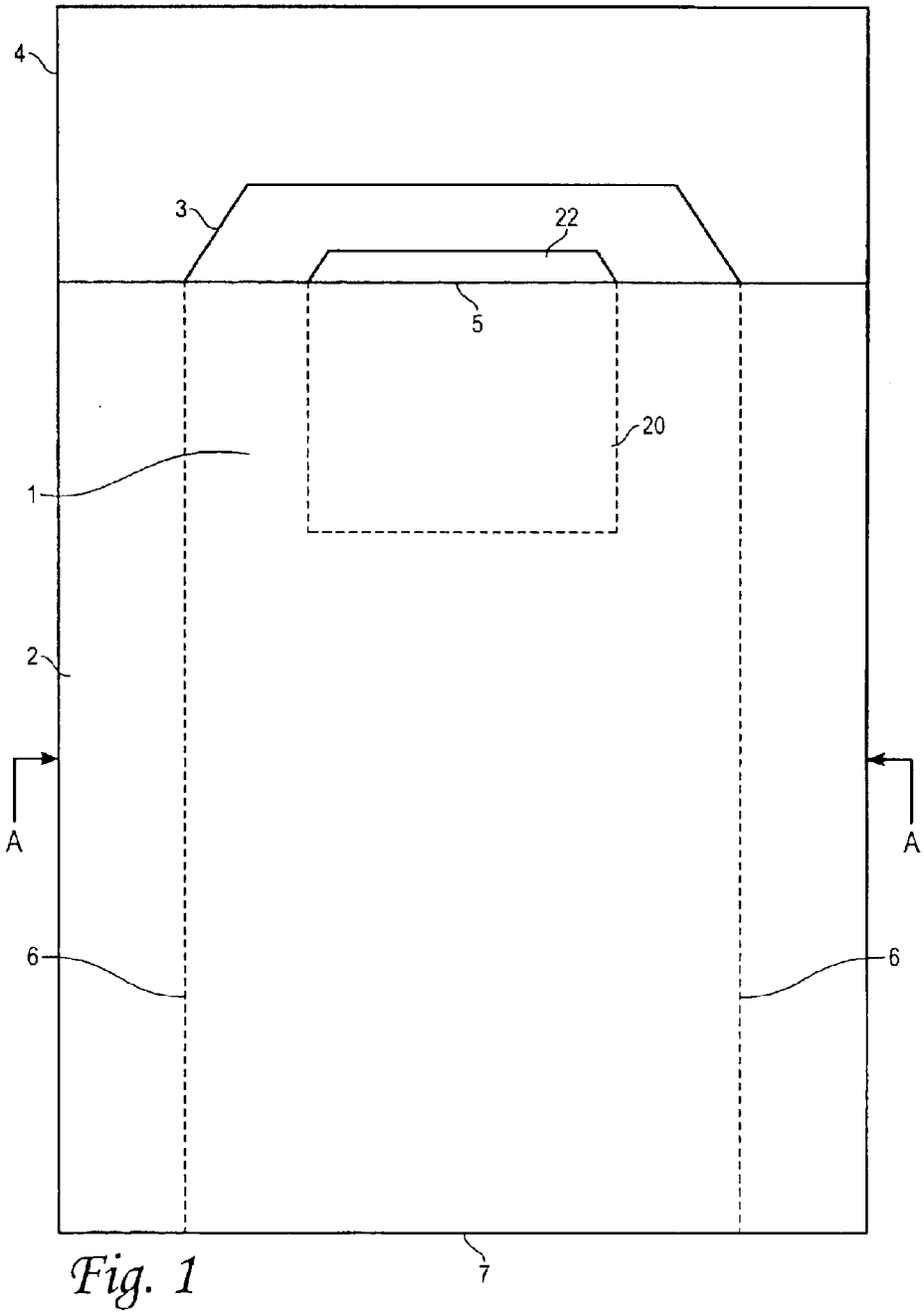
FIG. 1 is a back view of the barrier envelope.

With respect to FIG. 1, a barrier envelope in accord with the present invention is illustrated. The new barrier envelope is comprised of an inner compartment 1 and an outer compartment 2. Each compartment has a respective seal 3,4. In the illustrated embodiment the seals are flaps. Inner compartment seal 3 would be sealed first, and outer compartment seal 4 would be sealed second. Outer compartment seal 4 would seal over inner compartment seal 3, completely covering seal 3 and ensuring that both compartments were completely sealed.

In the illustrated embodiments, the seals are illustrated as flaps. These flaps fold along a single line at the opening of each compartment. It may be beneficial to have the flaps sealed by an adhesive that a user would expose by the removal of a release liner. An adhesive activated by moistening could pose risks to the user and could result in a less uniform and thus less secure seal of the opening of the envelope.

Alternative seals could be at the lip of each compartment, with the inner compartment having a seal that is further inside the compartment and the outer compartment having a seal that wholly encloses the inner compartment. Such a seal should be leak proof. Another alternative as a seal would be a zipper type seal, as is commonly used in resealable bags. Again, the inner compartment would be sealed first, and the outer compartment would seal over the first compartment. The seals of each compartment and the openings of each compartment are aligned, such that a test card or diagnostic device inserted into the opening of the first compartment would be also enclosed by the second compartment. The seals are aligned, such that the seals are roughly parallel. Once the first seal is used to seal shut the first compartment, the second seal encloses the entirety of the first compartment within a second compartment.

An opening 5 at the top edge of inner compartment 1 allows insertion of a test card. After insertion, opening 5 is sealed by flap 3. Flap 4 then seals over flap 3, enclosing inner compartment 1 in outer compartment 2. The top edges of outer compartment 2 may be affixed to the top outer lip of inner compartment 1. Thus opening 5 would be the only available space to insert the test card.

Inner compartment 1 may be made of a variety of materials. Although not required by the proposed Federal Regulations, it may be preferred to have the inner compartment made of a leakproof barrier. A water and gas impermeable barrier protects the test card from external exposure to liquids and gas. Given that oxidation of the reagents on some test cards degrades the diagnostic value of the assay, such a gas impermeable barrier may also have the advantage of protecting the card. This inner compartment may be made of a liquid and gas impermeable plastic or a laminated material, such as foil and paper (laminated foil), metallized polymeric materials or other material having similar properties (i.e. leak resistant). The dimensions of the inner compartment are selected to accommodate the size of the test card or sample pad to be mailed.

The outer compartment, in compliance with the regulations, should have a leakproof barrier. Section 8.5 of the proposed Federal Regulations state that more hazardous materials should be in packaging which would withstand, without leakage, an internal pressure that produces a pressure differential of not less than 0.95 bar, 14 psi (95 kPa). This packaging should also withstand temperatures in the range of −40° F. to 131° F. (−40° C. to 55° C.). This is well in excess of what is required for packaging to provide a leak proof barrier. Again, a number of co-extruded films, plastics, or laminates should be adaptable for this purpose. A laminate or material using Tyvek® polymer material (produced by DuPont, Wilmington, Del.) or another similar polymer could be used as the material for the outer compartment. Tyvek® polymer material is water resistant and much more resistant to tearing than paper. This presents certain advantages, such as the reduced risk that automated mail sorting machines would damage the envelope.

The outer compartment is sufficiently large to contain the inner compartment. The sides of the outer compartment may be sealed to the sides of inner compartment. In FIG. 1, line 6 shows the attachment area. Alternatively, one entire surface of inner compartment 1 may be sealed onto outer compartment 2. It is also possible to simply attach inner compartment 1 to outer compartment 2 at bottom 7. The compartments may be attached together using an adhesive, by heat sealing, or using some other attachment means. If the bottom of the envelope is not used to attach the inner compartment to the outer compartment, it may be folded and sealed in the ordinary manner.

Figure 2:
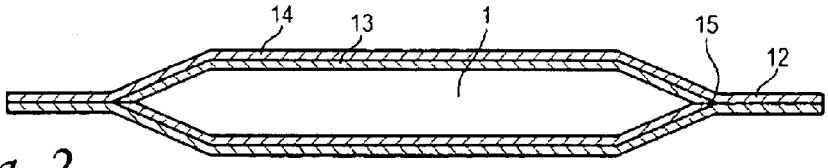
FIG. 2 is a cross sectional view along lines A of the envelope shown in FIG. 1.

With reference to FIG. 2, a cross section of the barrier envelope along line A of FIG. 1 shows the inner compartment 1 defined by material 13 that comprises the walls of inner compartment 1. Outer compartment 12 is defined by material 14 that comprises the walls of outer compartment 14. At edge 15, inner compartment material 13 is joined to outer compartment material 14. This may be done by heat sealing, adhesive application or some other means.

In one embodiment, the size of the envelope is sufficiently large to accommodate a fecal occult serial blood test card, such the as the Hemoccult® SENSA® test card sold by Beckman Coulter (Fullerton, Calif.). These cards typically measure 5.8124 inches in length by 3.25 inches in height and are 0.0425 inches thick. The size of the outer envelope preferably should not exceed the dimensions specified by the US Postal Service for first class mail. The envelope of the present invention is adaptable for use in mailing any of a number of diagnostic materials, including dried blood samples on a test card filter paper or strip, or other bodily fluid smears or secretions.

Each compartment has its own sealing means, either a flap, a tape-type seal, or a pressure close seal. This ensures that each compartment is securely sealed. The seal for the outer compartment may be similar to that disclosed in U.S. Pat. No. 5,150,971. Since the interior compartments are integrated into a unitary piece with the outer compartment, there is no likelihood that the envelopes could become separated.

In the illustrated embodiments, the barrier envelope has two compartments. However, any number of additional nested compartments may be used. All of the compartments would be adhered together. Each should have its own seal to enclose each compartment. The number of compartments required in part depends on the required use of the envelope. For example as shown in FIG. 1, a third center compartment 20 having sealable flap 22 may be used if required by industry need or federal regulation. This compartment would be within the inner compartment and have an opening aligned with the openings of the outer and inner compartments. This central compartment may also be leak resistant and/or tear resistant. It is joined along at least one seam to the other compartments, such that it could not be removed and possibly misplaced by a user.

If the material to be mailed is breakable (such as a glass slide) the inner compartment could contain a rigid plastic to protect the material being transported. In addition, additional padding and/or absorbent material may be used in the outer compartment. Either the inner or outer compartment may contain a desiccant (such as silica) to absorb any moisture within the compartments.

What is claimed is:

1. An envelope comprising:

an outer compartment having an outer compartment opening, said outer compartment having a leakproof barrier;

an outer compartment seal flap;

an inner compartment inside said outer compartment, said inner compartment having an inner compartment opening in line with said outer compartment opening;

an inner compartment seal flap;

wherein said inner compartment seal flap may be initially sealed independent of said outer compartment seal flap;

wherein said outer compartment seal closes over said inner compartment seal such that outer compartment seal flap completely covers said inner compartment seal flap and extends beyond the edges of said inner compartment seal flap, and wherein said inner compartment is permanently attached to said outer compartment;

a center compartment inside said inner compartment, said center compartment having a center compartment opening aligned with said outer compartment opening; and a center compartment seal that may seal the center compartment, wherein said inner compartment seal closes over said center compartment seal, wherein said center compartment is permanently attached to said outer compartment.

2. The envelope of claim 1, wherein said inner compartment is made of a laminate material.

3. The envelope of claim 1, wherein said inner compartment is chosen from the group consisting of laminated foil and metallized polymeric materials.

4. The envelope of claim 1, wherein the outer compartment is made of coextruded film.

5. The envelope of claim 1, wherein said inner compartment includes a leakproof barrier.

* * * * *